US005641616A

United States Patent [19]

Bertucci et al.

[11] Patent Number: 5,641,616

[45] Date of Patent: Jun. 24, 1997

[54] NON-REHALOGENATING BLEACHING COMPOSITION AND ITS USE TO PROCESS SILVER HALIDE PHOTOGRAPHIC ELEMENTS

[75] Inventors: Sidney Joseph Bertucci; Shirleyanne Elizabeth Haye; Eric Richard Schmittou, all of Rochester, N.Y.

[73] Assignee: Eastman Kodak Company, Rochester, N.Y.

[21] Appl. No.: 546,058

[22] Filed: Oct. 20, 1995

Related U.S. Application Data

[63] Continuation-in-part of Ser. No. 230,288, Apr. 20, 1994, abandoned.

[51] Int. Cl.[6] ..... G03C 7/42

[52] U.S. Cl. ..... 430/430; 430/393; 430/461; 430/943

[58] Field of Search ..... 430/393, 430, 430/461, 943

[56] References Cited

U.S. PATENT DOCUMENTS

| | | | |
|---|---|---|---|
| 3,817,751 | 6/1974 | Matejec et al. | 96/48 |
| 4,045,225 | 8/1977 | Shimamura et al. | 96/60 R |
| 4,113,490 | 9/1978 | Fujiwhara et al. | 96/60 R |
| 4,277,556 | 7/1981 | Koboshi et al. | 430/393 |
| 4,301,236 | 11/1981 | Idota et al. | 430/393 |
| 4,328,306 | 5/1982 | Idota et al. | 430/393 |
| 4,414,305 | 11/1983 | Nakamura et al. | 430/373 |
| 4,454,224 | 6/1984 | Brien et al. | 430/393 |
| 4,469,780 | 9/1984 | Hirai et al. | 430/373 |
| 4,524,129 | 6/1985 | Kishimoto et al. | 430/393 |
| 4,578,345 | 3/1986 | Ohno et al. | 430/393 |
| 4,681,838 | 7/1987 | Mifune et al. | 430/367 |
| 4,717,649 | 1/1988 | Hall et al. | 430/460 |
| 4,745,043 | 5/1988 | Hirai | 430/203 |
| 4,880,725 | 11/1989 | Hirai et al. | 430/373 |
| 4,954,425 | 9/1990 | Iwano | 430/373 |
| 5,464,728 | 11/1995 | Szajewski et al. | 430/393 |

FOREIGN PATENT DOCUMENTS

| | | |
|---|---|---|
| 4846334 | 7/1973 | Japan . |
| 54/01026 | 6/1977 | Japan . |
| 61/261739 | 11/1986 | Japan . |
| 61/250647 | 11/1986 | Japan . |
| 92/01972 | 2/1992 | WIPO . |
| 92/07300 | 4/1992 | WIPO . |
| 9311495 | 6/1993 | WIPO . |

OTHER PUBLICATIONS

Mason et al., *Photographic Processing Chemistry*, The Focal Press, New York, 1975, pp. 211–213.

*Primary Examiner*—Hoa Van Le

*Attorney, Agent, or Firm*—Sarah Meeks Roberts; J. Lanny Tucker

[57] ABSTRACT

A non-rehalogenating bleaching composition for processing imagewise exposed and developed silver halide photographic elements comprising hydrogen peroxide, or a compound which releases hydrogen peroxide, and at least one compound of Formula I $$[MO_2C—(L^1)_p]_q—R—[(L^2)_n—CO_2M]_m \quad (I)$$

wherein R is a substituted or unsubstituted aromatic hydrocarbon group, or a substituted or unsubstituted aromatic heterocyclic group containing at least one oxygen, nitrogen or sulfur atom;

$L^1$ and $L^2$ are each independently a substituted or unsubstituted linking group wherein the linking group is attached to the carboxyl group by a carbon;

n and p are independently 1 or 0;

m and q are independently 0, 1, 2, 3, 4, 5, or 6 and the sum of m+q is at least 1; and M is a hydrogen atom, an alkali metal, an alkaline earth metal or an ammonium ion. The composition has a pH of from about 2 to about 6 and is substantially free of rehalogenating agents and high valent metal ion complexes with any of polycarboxylic acids, aminocarboxylic acids and phosphonic acids.

8 Claims, No Drawings

NON-REHALOGENATING BLEACHING COMPOSITION AND ITS USE TO PROCESS SILVER HALIDE PHOTOGRAPHIC ELEMENTS

CROSS-REFERENCE TO RELATED APPLICATIONS

This is a continuation-in-part of application Ser. No. 08/230,288, filed Apr. 20, 1994, now abandoned, entitled "Hydrogen Peroxide Bleach Composition for Use With Silver Halide Photographic Elements" by S. Bertucci, S. Haye and E. Schmittou.

FIELD OF THE INVENTION

This invention relates to a non-rehalogenating peroxide bleaching composition and its use to bleach silver halide photographic elements. More specifically, this invention relates to novel ecologically advantageous bleaching compositions and to their use in the processing of the noted materials.

BACKGROUND OF THE INVENTION

The basic image-forming process of silver halide photography comprises the exposure of a silver halide photographic element to actinic radiation (for example, light or X-rays), and the manifestation of a usable image by the wet, chemical processing of the material. The fundamental steps of this processing entail, first, treatment (development) of the photographic element with one or more developing agents wherein some of the silver halide is reduced to metallic silver. With black-and-white photographic materials, such metallic silver can serve directly as a useful image. With color photographic materials, the useful image consists of one or more images in organic dyes produced from an oxidized developing agent formed where silver halide is reduced to metallic silver. Following development, the photographic material may be further treated with a variety of solutions to achieve specific desired effects.

With black-and-white photographic elements, development usually produces a material containing both a metallic silver image in exposed areas, and (undeveloped) silver halide in unexposed areas. Silver halide is light-sensitive, and over time may be converted to metallic silver directly by the action of light, a process commonly referred to as print-out. To prevent contamination of the chemically developed metallic silver image by print-out silver, undeveloped silver halide is generally removed from the developed material through treatment with a solution containing a silver halide solvent commonly referred to as a fixing agent. The topic of fixing agents and their use in photographic processing is thoroughly discussed by G. I. P. Levenson in *The Theory of the Photographic Process,* Fourth Edition, T. H. James (ed.), Macmillan Publishing Co., Inc., New York, 1977, Chapter 15, and by L. F. A. Mason in *Photographic Processing Chemistry,* Second Edition, The Focal Press, London, 1975, Chapter VI.

In an alternative process, commonly referred to as a black-and-white reversal process, undeveloped silver halide is left in the black-and-white photographic material after development, but the metallic silver formed as a result of development is removed in a separate processing step. After the metallic (developed) silver has been removed, the photographic material is given a second exposure to actinic radiation sufficient to cause it to be convertible to metallic silver in a subsequent (second) development step. The result of this alternative process is a metallic silver image in areas of the material that were initially not exposed, giving a "reversal" of the image formed in the process in which the development is followed by fixing.

The processing solutions used to oxidize metallic (developed) silver in a photographic material are commonly referred to as bleaches. A thorough discussion of photographic bleaches is also given by Levenson and in Chapter VII of Mason in the references cited above. In addition to their use in the black-and-white reversal process just described, bleaches are also commonly used in the processing of color photographic materials to remove the metallic silver produced by development and, thereby, prevent desaturation of the color dye images.

All photographic bleaches are solutions of oxidizing agents capable of converting metallic silver to silver ions. Specifically, the oxidizing (bleaching) agents convert silver from an oxidation state of zero (silver metal) to silver in an oxidation state of +1. Simultaneously, the oxidizing agent is reduced. As discussed by Levenson in the cited reference, the oxidizing power required of the bleach may be quantified in terms of an electrochemical potential whose value depends on the concentration of free silver ions in the material being bleached. The higher the free silver ion concentration, the greater the oxidizing power required of the bleaching agent.

After chemical development, silver is present in a photographic material as metallic silver and as undeveloped silver halide. Since the solubility of each of these materials is negligible in water, the concentration of free silver ions in the material is negligible, and bleaching will begin if the material is exposed to a bleach solution containing even a weak oxidant. As the oxidation of metallic silver proceeds and free silver ion increase, the electrochemical potential needed to continue silver oxidation increases. Only bleaches containing oxidants with very high electrochemical potentials will be able to oxidize all of the metallic silver in a developed photographic material in the presence of the free silver ion products of bleaching. A table showing the electrochemical potentials of oxidants useful in photographic bleaches is given on page 448 of the Levenson reference. If the level of free silver ion is kept low, oxidants of weaker oxidizing power are useful in photographic bleaches. One way to maintain a low concentration of free silver ion in a bleaching photographic material is to include in the bleach composition chemical species that will combine with free silver ion as it is generated by the oxidation of developed (metallic) silver. Two common classes of materials used for this purpose are halides that react with free silver ions to form insoluble silver halides within the photographic materials, and silver ion complexing agents. These complexing agents are generally also silver halide solvents, and bleaching solutions containing such complexing agents may act as a fixing bath as well as a bleach. Single solutions used to both bleach and fix a developed photographic material are commonly referred to as bleach-fixing solutions or bleach-fixers. Thus there are three possible types of photographic bleaches, differing in the final disposition of the silver ions formed from the oxidation of metallic silver. Rehalogenating bleaches contain halide ion in the bleaching solution. After treatment with a rehalogenating bleach all silver in the photographic material is in the form of silver halide. This silver halide is subsequently removed from the material in a fixing step.

Bleach-fixers are bleaching solutions containing silver halide solvents. Use of a bleach-fixer eliminates a separate fixing step. All silver, both developed metallic silver and undeveloped silver halide, is removed from a processed photographic material in a bleach-fixer.

Finally, simple bleaches contain no material, for example, halides or silver ion complexing agents, which will significantly lower the concentration of free silver ions produced by the oxidation of metallic silver formed by development. These simple bleaches are sometimes referred to as direct or non-rehalogenating bleaches. Since these simple bleaches contain no silver halide solvents, they have no effect on undeveloped silver halide, so that when a simple bleach is used, developed silver in the photographic material being bleached dissolves into the bleach while undeveloped silver halide is removed into a fixing bath.

Not all oxidants are useful in all three types of bleaches, and the formulation of a useful composition for each of the three types of bleaches requires a careful balance of the electrochemical potential of the oxidant with the redox properties of all other species in the bleach solution and in the material to be bleached. For example, only the most powerful oxidants are useful in direct bleaches. Among these are soluble salts of dichromate and permanganate. As noted above, direct bleaches based on these materials are useful in a black-and-white reversal process. On the other hand, direct bleaches based on dichromate and permanganate are often too powerful to use in bleaching developed silver in color photographic materials because they can oxidize dye images, or in bleach-fixers because they are powerful enough to oxidize commonly used fixing agents. Other oxidants, such as those based on Fe(III) salts or Fe(III) complexes, are too weak to oxidize silver without additional species (like halide or a silver ion complexing agent) in the bleach to lower the concentration of free silver ion formed as bleaching proceeds. With bromide, for example, Fe(III) compounds such as ferricyanide and Fe(III)-EDTA are capable of oxidizing silver rapidly enough to be useful as bleaches in the processing of color materials but are not so powerful as to cause oxidation (loss) of color image dyes. Since most good fixing agents are more readily oxidized than color image dyes, bleach-fixing solutions are generally of lower oxidative power than either direct or rehalogenating bleaches. As a result, their use is restricted to processes designed for specific photographic materials. Process RA-4 used for color photographic paper containing emulsions with high levels of chloride does employ a bleach-fixer based on an Fe(III) complex, but no useful bleach-fixer for photographic materials containing emulsions of low chloride levels, for example, high speed color negative films, is commercially available.

Because the utility of an oxidant in a particular type of bleach depends critically on its electrochemical potential, it can not, in general, be assumed that oxidants useful in one type of bleach will also be useful in another. For example, one cannot prepare a useful simple (non-rehalogenating) bleach by taking a rehalogenating bleach based on Fe(III) —such as the KODAK FLEXICOLOR BLEACH III—and simply remove the halide.

In addition to selecting bleach components based on the need to oxidize developed silver, there is increasing concern with regard to the effects that oxidants and other bleach components may have on the environment. Powerful oxidants such as those based on Cr(VI) and Mn(VII) and weaker agents such as aminopolycarboxylic acid chelates of Fe(III) are of concern from the point of view of environmental pollution. Concerns center around the effects of the heavy metal ions themselves and around chelating agents like EDTA commonly employed with Fe(III) that may help transport heavy metals to the soil and aqueous environment.

It is one purpose of the present invention to provide bleach formulations that have minimum negative environmental effects.

On the basis of their electrochemical potential and innocuous bleaching products, peroxy compounds such as persulfates and peroxides offer attractive alternatives to heavy metal ion bleaches. Persulfate bleaching agents that produce sulfate ion as the bleaching byproduct, have low environmental impact. Although persulfates are powerful oxidants based on their electrochemical potential, it has been found that persulfate bleaches are slow to oxidize silver in developed photographic materials, and to achieve useful bleaching rates require the use of a bleach accelerating agent.

Like persutfates, hydrogen peroxide also has an electrochemical potential that suggests that it might be useful as an oxidant in photographic bleaches. The electrochemical potential of hydrogen peroxide is high enough to suggest its use in direct bleaches. In addition, the reduced form of hydrogen peroxide—the result of its oxidation of metallic silver—is water, which is excellent from an environmental perspective. In *Oxygen, Elementary Forms and Hydrogen Peroxide,* published by W. A. Benjamin, New York, 1965, M. Ardon teaches that persulfates can decompose to form hydrogen peroxide in aqueous solutions below pH 1. At higher pH values, at pH 2 to 6, however, persulfate does not act as a hydrogen peroxide precursor. Thus, hydrogen peroxide must be provided in other ways.

Not surprisingly, numerous attempts to use hydrogen peroxide as a photographic bleach have been made, yet no hydrogen peroxide based bleach has found its way into the photographic trade. One problem with many hydrogen peroxide bleach formulations has been stability. Another is the tendency of hydrogen peroxide based bleaches to produce vesiculation (blistering) in photographic materials and to show incomplete bleaching.

Still, the use of hydrogen peroxide in combination with various compounds has been described. For example, U.S. Pat. No. 4,301,236 (Idota et al) describes a rehalogenating bleaching composition containing a combination of hydrogen peroxide, an organic metal complex salt such as Fe(III) -EDTA or Fe(III)-HEDTA, and an unsubstituted or substituted aromatic sulfonic acid. The presence of the sulfonic acid is said to increase the shelf stability (keep stability) of the hydrogen peroxide formulation. The patent also teaches that hydrogen peroxide alone is not a useful oxidant for bleaching color photographic materials (column 2, lines 50–54). Contrary to this teaching, the present invention describes useful bleaches in which hydrogen peroxide is the only oxidant.

U.S. Pat. No. 4,277,556 (Koboshi et al) describes a photographic bleaching composition containing acidic formulations of hydrogen peroxide with lower alkyl aliphatic carboxylic acids and/or alkylidene diphosphonic acids or alkali metal salts thereof.

In addition, WO 92/01972 describes a method of processing a photographic material that includes a redox amplification dye image-forming step and a bleach step using hydrogen peroxide. Other disclosures include U.S. Pat. No. 4,454,224 and WO 92/07300 that describe alkaline hydrogen peroxide solutions, and Japanese specifications 61/250647A and 61/261739A that describe hydrogen peroxide bleaches requiring bleach accelerators.

Despite all of the work being done to develop hydrogen peroxide bleaches, there is a continuing need for a commercially viable hydrogen peroxide bleach which is stable and non-vesiculating. It is the object of this invention to provide hydrogen peroxide bleaches which are simple and effective.

SUMMARY OF THE INVENTION

This invention provides a non-rehalogenating bleaching composition for processing imagewise exposed and developed silver halide photographic elements, the composition having a pH of from about 2 to about 6, and comprising:

a) hydrogen peroxide, or a compound which releases hydrogen peroxide, and b) at least one compound of Formula I $$[MO_2C—(L^1)_p]_q—R—[(L^2)_n—CO_2M]_m \quad (I)$$

wherein R is a substituted or unsubstituted aromatic hydrocarbon group, or a substituted or unsubstituted aromatic heterocyclic group containing at least one oxygen, nitrogen or sulfur atom;

$L^1$ and $L^2$ are each independently a substituted or unsubstituted linking group wherein the linking group is attached to the carboxyl group by a carbon;

n and p are independently 1 or 0;

m and q are independently 0, 1, 2, 3, 4, 5, or 6 and the sum of m+q is at least 1; and M is a hydrogen atom, an alkali metal, an alkaline earth metal or an ammonium ion;

provided that the bleaching composition is substantially free of:

rehalogenating agents, and any complex formed from a high valent metal ion and a polycarboxylic acid, aminocarboxylic acid or phosphonic acid.

This invention also provides a method for processing an imagewise exposed and developed silver halide photographic element comprising bleaching the photographic element with the non-rehalogenating hydrogen peroxide bleaching composition described above.

This invention provides non-rehalogenating bleach compositions that are effective, stable and non-vesiculating. These compositions suffer from no serious disadvantages that could limit their usefulness in photographic processing. Hydrogen peroxide is readily available, inexpensive and forms no by-products that are ecologically harmful. Moreover, these compositions work well in spite of the absence of rehalogenating agents, such as bromide, chloride and iodide, as well as in the absence of complexes of high valent metal ions and any of a polycarboxylic acid, aminocarboxylic acid or phosphonic acid.

DETAILED DESCRIPTION OF THE INVENTION

The bleaching compositions of this invention comprise hydrogen peroxide or compounds capable of releasing hydrogen peroxide, and one or more aromatic carboxylic acids or salts thereof described by Formula I:

$$[MO_2C—(L^1)_p]_q—R—[(L^2)_n—CO_2M]_m \quad (I)$$

wherein R is a substituted or unsubstituted aromatic hydrocarbon group (for example a phenyl group or a naphthyl group), or a substituted or unsubstituted aromatic heterocyclic group containing at least one oxygen, nitrogen or sulfur atom (for example a pyridyl group, an imidazolyl group, or a quinolinyl group). Preferably, R is an aromatic heterocyclic group having 2 to 12 carbon atoms or a hydrocarbon aromatic group having 6 to 14 carbon atoms.

Examples of substituents of R include aliphatic groups containing 1 to 10 carbon atoms, or aromatic hydrocarbon groups (each of which may be substituted by one or more, sulfonate groups, sulfate groups, carboxy groups, hydroxy groups, oxide or oxo groups, amine groups, amine oxide groups, phosphonic acid groups, amide groups, sulfonamide groups, nitro groups, nitroso groups, cyano groups, or halogen atoms; each of which may contain one or more aromatic or heteroaromatic linkages, oxygen atoms (ether linkages), sulfonyl linkages, sulfoxy linkages, amide linkages, ester linkages, sulfonamide linkages, amine linkages, amine oxide linkages, and the like), sulfonate groups, sulfate groups, carboxy groups, hydroxy groups, oxide or oxo groups, amine groups, amine oxide groups, amide or sulfonamide groups, nitro groups, nitroso groups, cyano groups, or halogen atoms.

$L^1$ and $L^2$ are each independently a substituted or unsubstituted linking group wherein the linking group is attached to the carboxyl group by a carbon atom. Preferably the linking groups contain 1 to 10 carbon atoms, and more preferably they contain 1 to 4 carbon atoms. The carbon atoms of the linking groups may be linked together by one or more aromatic or heteroaromatic linkages (e.g., phenylene groups), oxygen atoms(ether linkages), sulfonyl linkages, sulfoxy linkages, amide linkages, ester linkages, sulfonamide linkages, amine linkages, amine oxide linkages and the like. The linking groups may be straight- or branched-chain, substituted or unsubstituted. Examples of suitable substituents include one or more sulfonate groups, sulfate groups, carboxy groups, hydroxy groups, phosphonic acid groups, amine groups, amine oxide groups, amide groups, sulfonamide groups, nitro groups, nitroso groups, cyano groups or halogen atoms. The linking groups $L^1$ and $L^2$ may also be substituted with one or more aromatic groups, generally defined the same as R above. Some preferred compounds containing linking groups are phenoxyacetic acid and phenylacetic acid.

n and p are independently 1 or 0, and more preferably n and p are each 0. m and q are independently 0, 1, 2, 3, 4, 5, or 6 and the sum of m+q must be at least 1. M is hydrogen, an ammonium atom defined as a mono-, di-, tri-, or tetra-substituted ammonium ion, which may be substituted with 1–4 aryl groups or alkyl groups with 1–6 carbon atoms, or an alkali metal or alkaline earth metal cation. More preferably M is hydrogen or a sodium or potassium ion.

In one preferred embodiment R is an aromatic hydrocarbon group; and m+q is at least 2, or R is substituted with one or more sulfonate groups. Some preferred compounds of Formula I are sulfobenzoic acids, sulfonaphthalenecarboxylic acids, benzenedicarboxylic acids, naphthalenedicarboxylic acids, sulfobenzenedicarboxylic acids, sulfonaphthalenedicarboxylic acids, benzenetricarboxylic acids, sulfobenzenetricarboxylic acids, benzenetetracarboxylic acids, and disulfobenzenecarboxylic acids, or salts thereof. More preferred compounds include m-sulfobenzoic acid, phthalic acid, 4-sulfophthalic acid, 5-sulfoisophthalic acid, and 3-sulfophthalic acid, or salts thereof.

While many combinations of alkylene and aromatic groups and substituents describe compounds that satisfy the description of General Formula I, it is necessary that these groups and substituents describe a compound that is soluble in the bleach at the pH at which the bleach is to be used. The compound should be soluble in the aqueous bleach solution at a concentration greater than about 0.001 mol/l, preferably greater than about 0.01 mol/l.

The compounds of Formula I may be used at a concentration of from about 0.01 to about 2.0 mol/l. More preferably the compounds are used at a concentration of from about 0.03 to about 1.0 mol/l. The compounds of Formula I may be used alone or in combinations of two or more.

In a preferred embodiment an organic phosphonic acid is added to the bleaching solution. Preferred phosphonic acids have Formulas VI or VII:

$$R^7N(CH_2PO_3M'_2)_2 \quad (VI)$$

wherein M' represents a hydrogen atom or a cation imparting water solubility (e.g., an alkali metal) or an ammonium, pyridinium, triethanolammonium or triethylammonium ion). $R^7$ represents an alkyl group, an alkylaminoalkyl group or an alkoxyalkyl group having from 1 to 4 carbon atoms (e.g., methyl, ethyl, propyl, isopropyl, and butyl groups, and ethoxyethyl and ethylaminoethyl groups), an aryl group (e.g., phenyl, o-tolyl, m-tolyl, p-tolyl and p-carboxyphenyl groups,), an aralkyl group (e.g., benzyl, β-phenethyl, and o-acetamidobenzyl groups, and preferably an aralkyl group having from 7 to 9 carbon atoms), an alicyclic group (e.g., cyclohexyl and cyclopentyl groups), or a heterocyclic group (e.g., 2-pyridylmethyl, 4-(N-pyrrolidino)butyl, 2-(N-morpholino)ethyl, benzothiazolylmethyl, and tetrahydroquinolylmethyl groups), each of which (particularly the alkyl group, the alkoxyalkyl group, or the alkylaminoalkyl group) may be substituted with a hydroxyl group, an alkoxy group (e.g., methoxy and ethoxy groups), a halogen atom, or $—PO_3M'_2$, $—CH_2PO_3M'_2$, or $—N(CH_2PO_3M'_2)_2$, wherein M' is as defined above; or $$R^8R^9C(PO_3M'_2)_2 \quad (VII)$$

wherein M' is as defined above. $R^8$ represents a hydrogen atom, an alkyl group, an aralkyl group, an alicyclic group, or a heterocyclic group, or $—CHR^{10}—PO_3M'_2$ (wherein M' is as defined above). $R^9$ represents a hydrogen atom, a hydroxyl group, or an alkyl group) or the above defined substituted alkyl group, or $—PO_3M'_2$ (wherein M' is as defined above.

Representative examples of useful phosphonic acids are shown below.

(1) Ethylenediamine-N,N,N',N'-tetramethylenephosphonic acid (2) Nitrilo-N,N,N-trimethylenephosphonic acid (3) 1,2-Cyclohexanediamine-N,N,N',N'-tetramethylenephosphonic acid (4) o-Carboxyaniline-N,N-dimethylenephosphonic acid (5) propylamine-N,N-dimethylenephosphonic acid (6) 4-(N-Pyrrolidino)butylamine-N,N-bis (methylenephosphonic acid)

(7) 1,3-Diamino-2-propanol-N,N,N',N'-tetramethylenephosphonic acid (8) 1,3-Propanediamine-N,N,N',N'-tetramethylenephosphonic acid (9) 1,6-Hexanediamine-N,N,N',N'-tetramethylenephosphonic acid

(10) o-Acetamidobenzylamine-N,N-dimethylenephosphonic acid

(11) o-Toluidine-N,N-dimethylenephosphonic acid

(12) 2Pyridylmethylamine-N,N-dimethylenephosphonic acid

(13) 1-Hydroxyethane-1,1-diphosphonic acid

(14) Diethylenetriamine-N,N,N',N",N"-penta (methylenephosphonic acid)

(15) 1-Hydroxy-2-phenylethane-1,1-diphosphonic acid

(16) 2-Hydroxyethane-1,1-diphosphonic acid

(17) 1-Hydroxyethane-1,1,2-triphosphonic acid

(18) 2-Hydroxyethane-1,1,2-triphosphonic acid

(19) Ethane-1,1-diphosphonic acid

(20) Ethane-1,2-diphosphonic acid

The organic phosphonic acid compound is present in the bleaching composition in an amount of from about 0.0005 to about 0.02 mol/l, and preferably from about 0.0005 to about 0.012 mol/l. The use of the phosphonic acid in the bleaching composition reduces vesiculation during processing.

For the purpose of minimizing any further reaction of oxidized color developing agent with dye-forming compounds in the photographic element during bleaching, it is necessary that one or more additional treatments be performed between color development and bleaching as described above. Among such treatments are contacting the element with an acidic processing solution (such as dilute sulfuric or acetic acid stop bath solutions or buffer solutions, with a pH preferably of from about 1 to about 7); contacting the element with a water wash bath (or rinse) having a pH ranging from about 3 to about 7; or wiping the photographic element with a squeegee or other device that minimizes the amount of processing solution that is carried by the photographic element from one processing solution to another. Most preferably, an acidic stop bath is used between color development and hydrogen peroxide bleaching.

The bleaching agent utilized in the bleaching compositions of this invention is hydrogen peroxide or a hydrogen peroxide precursor such as perborate, percarbonate, or hydrogen peroxide urea. For purposes of this invention, persulfate is not a precursor for hydrogen peroxide because in aqueous solutions at a pH of from about 2 to about 6, persulfate fails to generate sufficient amounts of hydrogen peroxide to be useful as a hydrogen peroxide precursor in the practice of this invention.

The amount of hydrogen peroxide or hydrogen peroxide releasing compound used in the processing solution of this invention depends on many variables including the kind of compound used in combination with the hydrogen peroxide, the type of photographic material, the processing time and the processing temperature (see suggested times and temperatures below). In general, the smaller the added amount, the longer the treatment period necessary. When the added amount is greater than necessary, the reaction becomes extremely active and vesiculation may occur. A worker skilled in the art would know how to determine the appropriate amount of hydrogen peroxide or hydrogen peroxide precursor for a given set of conditions using routine experimentation.

Thus, the hydrogen peroxide bleaching agent is generally present in an amount of from about 0.05 to about 5 mol/l, and more preferably from about 0.1 to 3 mol/l, depending upon the factors noted above. For example, for processing silver bromoiodide emulsions, most preferably, the hydrogen peroxide is present in an amount of from about 1 to about 2.5 mol/l. When a hydrogen peroxide precursor is used, the amount of precursor present must be that sufficient to provide the just described amounts of hydrogen peroxide at the composition pH. A skilled artisan would know how to determine this amount of precursor using routine experimentation.

Examples of hydrogen peroxide formulations are described in *Research Disclosure,* publication 36544, pages 501–541 (September 1994). *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011). This reference will be referred to hereinafter as "*Research Disclosure*". Additional hydrogen peroxide formulations are described in U.S. Pat. Nos. 4,277,556; 4,328,306; 4,454,224; 4,717,649; 4,737,450; 4,301,236; and in EP 0,428,101; WO 92/01972 and WO 92/07300.

The bleaching compositions may be used at a pH of 2 to 6, but are more preferably used at a pH of 3 to 6. Preferably, a stop bath (as described above) of pH≦7 precedes the bleaching step. The bleach compositions of this invention can adequately bleach a wide variety of photographic elements in from about 30 to about 600 seconds. The processing temperature of the bleaching solution is from about 20° to about 60° C., and more preferably from about 25° to about 40° C. for rapid treatment.

Further, it has been found that bleaching can be enhanced when silver(I) is present in the bleaching composition. Silver(I) can be provided from any suitable source, and particularly from inorganic and organic silver salts added to the composition. Many useful salts are well known in the art. For reasons of effectiveness, availability, low cost and environmental concerns, the preferred silver salts are the nitrate, sulfate, acetate, lactate, and methanesulfonate salts. Alternatively, silver(I) can be provided from metallic silver added to the bleaching composition or from oxidized silver from the photographic material.

The amount of silver that may be added is from about $10^{-5}$ to about 0.5 mol/l and preferably from about $10^{-4}$ to about $10^{-1}$ mol/l. This amount may vary depending on the kind of salts used, the type of silver halide photographic materials to be treated, treatment times, and treatment conditions.

As noted above, the bleaching compositions of this invention are "non-rehalogenating". No rehalogenating agent (such as iodide, bromide or chloride) is purposely added to the bleaching compositions. There may be inconsequential amounts, that is less than $10^{-5}$ mol/l of soluble halide, that leach out of processed elements or are carried over from preceding processing solutions.

In the absence of rehalogenating amounts of soluble halide (e.g., chloride) in the bleaching composition, the developed silver of the photographic element is dissolved and partially or completely washed out of the element and into the bleaching solution once it has become oxidized by the bleaching solution.

The bleaching compositions of this invention are also substantially free of a complex of a high valent metal ion and a polycarboxylic acid represented by Formula II, an aminocarboxylic acid represented by Formula III or a phosphonic acid representedby Formula IV or V.

The polycarboxylic acids are defined as:

$$R^1(COOH)_t \qquad \text{(II)}$$

wherein $R^1$ represents a single bond, an unsubstituted or substituted alkylene group having 1 to 6 carbon atoms wherein the substituent is a hydroxy group and/or a carboxy group, a $—(CH_2)_m—O—(CH_2)_n—$ group wherein m and n are integers and m+n is 2 to 6, a $—(CH_2)_{m'}—S—(CH_2)_{n'}—$ group wherein m' and n' are integers and m'+n' is 2 to 6, or an alkenylene group having 2 to 6 carbon atoms; t is 2 or 3; and when $R^1$ is a single bond, t is 2.

The aminocarboxylic acids are defined as:

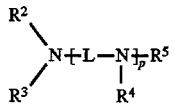

(III)

wherein $R^2$, $R^3$, $R^4$ and $R^5$ each represents a carboxyalkyl group wherein the alkyl moiety has 1 to 2 carbon atoms, a hydroxyalkyl group having 1 to 2 carbon atoms and/or a hydrogen atom, and p represents zero or an integer of 1 to 3. L represents an alkylene group having 2 to 4 carbon atoms; a $$\left[CH_2\right]_x\left[O\left[CH_2\right]_y\right]_z$$

group wherein x is an integer of 2 to 4, y is an integer of 2 to 4 and z is an integer of 1 to 3; a 6-membered cyclic alkylene group; or an arylene group. The aminocarboxylic acid of the formula (III) has at least 1 carboxy group.

The phosphonic acids are defined as:

$$R^6[PO_3H_2]_q \qquad \text{(IV)}$$

$$R^6[LPO_3H_2]_q \qquad \text{(V)}$$

wherein $R^6$ represents a substituted or unsubstituted alkyl or alkylene group having 1 to 4 carbon atoms wherein the substituent is a hydroxy group and/or a carboxy group, or a substituted or unsubstituted diaminoalkylene group having 2 to 16 carbon atoms wherein the substituent is a hydroxy group. L represents an alkylene group having 1 to 2 carbon atoms; and q represents an integer of 1 to 5.

A high valent metal has a normal valence greater than +1 such as iron(II), iron(III), copper(II), cobalt(II) and nickel (II). For example, the bleaching compositions of this invention are substantially free of iron complexes of the noted organic acids (such as PDTA or EDTA). It should be noted that silver, in its normal valence state (+1), is not a high valent metal. The term "substantially free" means less than $10^{-4}$ mol/l of the high valent metal ion. Such amounts are ineffective as bleaching agents.

Examples of counterions that may be associated with the various salts in these bleaching solutions are sodium, potassium, ammonium, and tetraatkylammonium cations. It may be preferable to utilize alkali metal cations. Additionally, the bleaching solution may contain corrosion inhibitors, such as nitrate ion.

The bleaching compositions may also contain other addenda known in the art to be useful in bleaching compositions, such as sequestering agents, polymers such as poly-N-vinylpyrrolidone, fluorescent brightening agents, and defoamers and other kinds of surface active agents. The bleach compositions may also contain, depending upon the kind of photographic materials to be treated, hardening agents such as an alum or antiswelling agents, for example, magnesium sulfate.

The bleach composition may also contain one or more buffering agents that will maintain the desired pH. Such buffering agents include phosphates, sulfates, acetic acid, sodium acetate, and others known in the art. If necessary, the compositions can contain hydrogen peroxide stabilizers such as acetanilide, pyrophosphoric acid, urea oxine, barbituric acid and mixtures of metal complexing agents as described in WO 93/11459. The bleaching compositions described here may be formulated as the working bleach solutions, solution concentrates, or dry powders. They may be used as bleach replenishers as well.

In addition, the compound of Formula I may be used in combination with water-soluble aliphatic carboxylic acids such as acetic acid, citric acid, propionic acid, hydroxyacetic acid, burytic acid, malonic acid, succinic acid and the like. These may be utilized in any effective amount. The compounds of Formula I may also be used in combination with sulfonic acids and salts, particularly those having the formula $$R—(O)_n—SO_3M$$

wherein R is a group having 1 to 10 carbon atoms;

n is 0 or 1; and

M is a hydrogen atom, an alkali metal, an alkaline earth metal or an ammonium ion.

Examples of how the bleach compositions of this invention may be utilized are shown below:

(1) Black and white first development→stopping→ water washing→color development→stopping→ bleaching→water washing→stabilization→drying.

(2) Black and white first development→water washing→ fog bath→color development→rinsing→bleaching→ water washing→stabilization→drying.

(3) Pre-hardening→neutralization→black and white first development→water washing→color development→ stopping→bleaching→washing→stabilization→drying.

(4) Black and white first development→stopping→ water washing→color development→hardening→neutralization→bleaching→water washing→stabilization→drying.

(5) Black and white first development→stopping→color development→stopping→black and white second development→rinsing→bleaching→water washing→stabilization→drying.

(6) Black and white first development→stopping→water washing→color development→stopping→bleaching→ water washing→stabilization→drying.

(7) Black and white first development→stopping→ bleaching→water washing→color development→ stopping→bleaching→water washing→stabilization→ drying.

(8) Black and white first development→water washing→ fog bath→color development→stopping→water washing→ bleaching→washing→fixing→washing→stabilization→ drying.

(9) Black and white development→stopping→washing→ bleaching→washing→fixing→washing→stabilization→ drying.

(10) Color development→stopping→bleaching→water washing→fixing→water washing→stabilization→drying.

(11) Color development→stopping→water washing→ bleaching→fixing→water washing→stabilization→drying.

(12) Color development→rinsing→bleaching→fixing→ water washing→stabilization→drying.

(13) Color development→stop-fixing→water washing→ bleaching→water washing→stabilization→drying.

(14) Color development→stopping→bleaching→water washing→stabilization→drying.

(15) Hardening→neutralization→color development→rinsing→bleaching→water washing→stabilization→drying.

(16) Color development→stopping→water washing→black and white development→water washing→bleaching→washing→stabilization→drying.

(17) Color development→water washing→dye-bleaching→water washing→bleaching→water washing.

(18) Color development→stopping→water washing→bleaching→water washing→fixing→water washing→stabilization→drying.

(19) Color development→stopping→water washing→ black and white development→water washing→ bleaching→washing→fixing→washing→stabilization→ drying.

(20) Black and white first development→stopping→ washing→bleaching→washing→fogging→black and white second development→washing→stabilization→ drying.

The compositions of this invention may be useful with Low Volume Thin Tank processors. A Low Volume Thin Tank processor provides a small volume for holding the processing solution. As a part of limiting the volume of the processing solution, a narrow processing channel is provided. The processing channel, for a processor used for photographic paper, should have a thickness equal to or less than about 50 times the thickness of the paper being processed, preferably a thickness equal to or less than about 10 times the paper thickness. In a processor for processing photographic film, the thickness of the processing channel should be equal to or less than about 100 times the thickness of photosensitive film, preferably, equal to or less than about 18 times the thickness of the photographic film. An example of a low volume thin tank processor that processes paper having a thickness of about 0.008 inches would have a channel thickness of about 0.080 inches and a processor that processes film having a thickness of about 0.0055 inches would have a channel thickness of about 0.1 inches. Further details about such processing methods and equipment are provided in U.S. Pat. No. 5,436,118 (Carli et al), incorporated herein by reference, and in publications cited therein.

The bleaching compositions of this invention may be used in a process with any compatible fixing solution. Examples of fixing agents that may be used are water-soluble solvents for silver halide such as: a thiosulfate (e.g., sodium thiosulfate and ammonium thiosulfate); a thiocyanate (e.g., sodium thiocyanate and ammonium thiocyanate); a thioether compound (e.g., ethylenebisthioglycolic acid and 3,6-dithia-1, 8-octanediol); a thiourea; or a sulfite(e.g., sodium sulfite). These fixing agents can be used singly or in combination.

The concentration of the fixing agent is preferably from about 0.1 to about 3 mol/l. The pH range of the fixing solution is preferably from about 3 to about 10 and more preferably from about 4 to about 9. In order to adjust the pH of the fixing solution an acid or a base may be added, such as hydrochloric acid, sulfuric acid, phosphoric acid, nitric acid, acetic acid, bicarbonate, ammonia, potassium hydroxide, sodium hydroxide, sodium carbonate or potassium carbonate.

The fixing solution may also contain a preservative such as a sulfite (e.g., sodium sulfite, potassium sulfite, and ammonium sulfite), a bisulfite (e.g., ammonium bisulfite, sodium bisulfite, and potassium bisulfite), and a metabisulfite (e.g., potassium metabisulfite, sodium metabisulfite, and ammonium metabisulfite). The content of these compounds is from 0 to about 1.0 mol/l, and more preferably from about 0.02 to about 0.7 mol/l as an amount of sulfite ion. Ascorbic acid, a carbonyl bisulfite acid adduct, or a carbonyl compound may also be used as a preservative.

The bleaching and fixing baths may have any desired tank configuration including multiple tanks, counter current and/ or co-current flow tank configurations.

A stabilizer bath is commonly employed for final washing and/or hardening of the bleached and fixed photographic element prior to drying. Alternatively, a final rinse may be used. Additionally, a bath can be employed prior to color development, such as a prehardening bath, or a washing step may follow the stabilizing step. Other additional washing steps may be utilized. Additionally, reversal processes that have the additional steps of black and white development, chemical fogging bath, light re-exposure, and washing before the color development are contemplated. In reversal processing there is often a bath that precedes the bleach that may serve many functions, such as a clearing bath or a stabilizing bath. Conventional techniques for processing are illustrated by Research Disclosure, noted above.

These compositions can be used for the bleaching of a wide variety of silver halide based photographic materials. The preferred elements for bleaching comprise silver halide emulsions including silver bromide, silver iodide, silver bromoiodide, silver chloride, silver chloroiodide, silver chlorobromide, and silver chlorobromoiodide.

The photographic elements of this invention can be black and white elements, single color elements, or multicolor elements. Multicolor elements typically contain dye image-forming units sensitive to each of the three primary regions of the visible spectrum. Each unit can be comprised of a single emulsion layer or of multiple emulsion layers sensitive to a given region of the spectrum. The layers of the element, including the layers of the image-forming units, can be arranged in various orders as known in the art. In an alternative format, the emulsions sensitive to each of the three primary regions of the spectrum can be disposed as a single segmented layer, e.g., as by the use of microvessels as described in U.S. Pat. No. 4,362,806 (Whitmore). The element can contain additional layers such as filter layers, interlayers, overcoat layers, subbing layers and the like. The element may also contain a magnetic backing such as described in *Research Disclosure,* No. 34390, November 1992.

The silver halide emulsions employed in the elements of this invention can be either negative-working or positive-working. Examples of suitable emulsions and their preparation are described in Research Disclosure, noted above and the publications cited therein. Other suitable emulsions are (111) tabular silver chloride emulsions such as described in U.S. Pat. Nos. 5,176,991 (Jones et al); 5,176,992 (Maskasky et al); 5,178,997 (Maskasky); 5,178,998 (Maskasky et al); 5,183,732 (Maskasky); and 5,185,239 (Maskasky) and (100) tabular silver chloride emulsions such as described in EPO 534,395, published Mar. 31, 1993, (Brust et al). Some of the suitable vehicles for the emulsion layers and other layers of elements of this invention are described in *Research Disclosure,* noted above and the publications cited therein.

The silver halide emulsions can be chemically and spectrally sensitized in a variety of ways, examples of which are described in *Research Disclosure*. The elements of the invention can include various couplers including, but not limited to, those described in *Research Disclosure* and the publications cited therein. These couplers can be incorporated in the elements and emulsions as described in *Research Disclosure* and the publications cited therein.

The photographic elements of this invention or individual layers thereof can contain among other things brighteners, antifoggants and stabilizers, antistain agents and image dye stabilizers, light absorbing and scattering materials, hardeners, plasticizers and lubricants, antistatic agents, matting agents and development modifiers, examples of all of which are described in *Research Disclosure* and publications cited therein.

The photographic elements can be coated on a variety of supports known in the art.

Photographic elements can be exposed to actinic radiation, typically in the visible region of the spectrum, to form a latent image as is known in the art and then processed to form a visible dye image. Processing to form a visible dye image includes the step of contacting the element with a color developing agent to reduce developable silver halide and oxidize the color developing agent. Oxidized color developing agent in turn reacts with the coupler to yield a dye.

For black and white development the common black and white developers may be used. They may be used in a black and white first development solution for light-sensitive color photographic materials, or black and white development solutions for light-sensitive black and white photographic materials. Some examples of typical developing agents include the p-aminophenols, such as Metol; the polyhydroxybenzenes such as hydroquinone and catechol; and the pyrazolidones (phenidones), such as 1-phenyl-3-pyrazolidone. These developers may be utilized alone or in combination.

Representative additives that may be used with black and white developers include anti-oxidizing agents such as sulfites; accelerators comprising an alkali such as sodium hydroxide, sodium carbonate and potassium carbonate; organic or inorganic retarders such as potassium bromide, 2-mercaptobenzimidazole or methylbenzthiazole; water softeners such as polyphosphates; or surface perdevelopment-preventing agents comprising a trace amount of potassium iodide or mercaptides.

The color developing solutions typically contain a primary aromatic amine color developing agent. These color developing agents are well known and widely used in variety of color photographic processes. They include aminophenols and p-phenylenediamines.

Examples of aminophenol developing agents include o-aminophenol, p-aminophenol, 5-amino-2-hydroxytoluene, 2-amino-3-hydroxytoluene, 2-hydroxy-3-amino-1,4-dimethylbenzene, and the like.

Particularly useful primary aromatic amine color developing agents are the p-phenylenediamines and especially the N-N-dialkyl-p-phenylenediamines in which the alkyl groups or the aromatic nucleus can be substituted or unsubstituted. Examples of useful p-phenylenediamine color developing agents include: N-N-diethyl-p-phenylenediamine monohydrochloride, 4-N,N-diethyl-2-methylphenylenediamine monohydrochloride, 4-(N-ethyl-N-2-methanesulfonylaminoethyl)-2-methylphenylenediamine sesquisulfate monohydrate, and 4-(N-ethyl-N-2-hydroxyethyl)-2-methylphenylenediamine sulfate.

In addition to the primary aromatic amine color developing agent, color developing solutions typically contain a variety of other agents such as alkalies to control pH, bromides, iodides, benzyl alcohol, antioxidants, antifoggants, solubilizing agents, brightening agents, and so forth. Particularly useful antioxidants are substituted dialkylhydroxylamines, such as N-isopropyl-N-(ethanesulfonic acid)hydroxylamine.

Photographic color developing compositions are employed in the form of aqueous alkaline working solutions having a pH of above 7 and most typically in the range of from about 9 to about 13. To provide the necessary pH, they contain one or more of the well known and widely used pH buffering agents, such as the alkali metal carbonates or phosphates. Potassium carbonate is especially useful as a pH buffering agent for color developing compositions.

With negative working silver halide, the processing step described above gives a negative image. To obtain a positive (or reversal) image, this step can be preceded by development with a non-chromogenic developing agent to develop exposed silver halide, but not form dye, and then uniformly fogging the element to render unexposed silver halide developable. Alternatively, a direct positive emulsion can be employed to obtain a positive image.

As used herein to define amounts and times, the term "about" refers to a variance of ±10% of the indicated value unless otherwise indicated. For temperature, it refers to a variance of ±5° C., and for pH it refers to a variance of ±0.25 pH unit.

The following examples are intended to illustrate, but not limit, this invention. Unless otherwise indicated, all percentages are by weight.

EXAMPLE 1

KODAK GOLD 100 PLUS Color Negative Film (5102) was exposed for 1/25 seconds with a 600 W 5500 K light source through a 21-step 0–4.0 density step tablet. The exposed strips were processed at 100° F. according to the protocol shown below. The bleach used was either the comparative iron chelate bleach or inventive Bleaches A or B.

| Solution | Time (min) |
|---|---|
| Color Developer | 3.25 |
| Acid Stop Bath | 1.00 |
| Water Wash | 3.00 |
| Bleach | 5.00 |
| Water Wash | 2.00 |
| Fix | 5.00 |
| Water Wash | 5.00 |
| Stabilizer | 0.50 |

| Component | Concentration |
|---|---|
| Color Developer | |
| Potassium carbonate | 34.30 g/l |
| Potassium bicarbonate | 2.32 g/l |
| Sodium sulfite | 0.38 g/l |
| Sodium metabisulfite | 2.78 g/l |
| Potassium iodide | 1.20 mg/l |
| Sodium bromide | 1.31 g/l |
| Diethylenetriaminepentaacetic acid pentasodium salt | 3.37 g/l |
| Hydroxylamine sulfate | 2.41 g/l |
| 4-(N-ethyl-N-(2-hydroxyethyl)-amino)-2-methylaniline sulfate | 4.52 g/l |
| pH | 10.0 |
| Acid Stop Bath | |
| Glacial acetic acid | 30 ml/l |
| Fixer | |
| Sodium Thiosulfate pentahydrate | 240 g/l |
| Sodium sulfite anhydrous | 10 g/l |
| Sodium bisulfite | 25 g/l |
| water to make | 1 liter |
| Stabilizer | |
| Photo-Flo 200 Solution (manufactured by Eastman Kodak Co.) | 3 ml/l |
| Comparative Bleach | |
| Ammonium bromide | 25.0 g/l |
| 1,3-Diaminopropanetetraacetic acid | 37.4 g/l |
| Ferric nitrate nonahydrate | 45 g/l |
| 28% aqueous ammonia | 70 mL/l |
| Glacial acetic acid | 80 mL/l |
| 1,3-Diamino-2-hydroxypropane-N,N,N',N'-tetraacetic acid | 0.8 g/l |
| pH | 4.75 |
| Bleach A | |
| water | 750 ml |
| m-sulfobenzoic acid, monosodium salt | 56 g |
| 30% hydrogen peroxide | 100 ml |
| 50% NaOH | 6.0 ml |
| silver nitrate (in 40 ml $H_2O$) | 0.80 g |
| water added to final volume of 1 liter | |
| final pH 3.75 | |
| Bleach B | |
| water | 750 ml |
| phthalic acid monopotassium salt | 41 g |
| 30% hydrogen peroxide | 100 ml |
| 50% NaOH | 2.1 ml |
| silver nitrate (in 40 ml $H_2O$) | 0.80 g |
| water added to final volume of 1 liter | |
| final pH 4.46 | |

The residual silver levels in the processed strips were determinedby X-ray fluorescence and are shown in Table I. The data in Table I demonstrates that the two inventive bleaches, Bleach A and Bleach B, desilver the developed film as well as the comparative iron chelate bleach. No vesiculation was observed in the bleached strips.

TABLE I

| | Residual Silver ($g/m^2$) | | | |
|---|---|---|---|---|
| Step No. | No Bleach | Comparative | Bleach A | Bleach B |
| 1.0 | 1.23 | 0.015 | 0.002 | 0.025 |
| 2.0 | 1.17 | 0.022 | 0.011 | 0.011 |
| 3.0 | 1.10 | 0.007 | 0.011 | 0.015 |
| 4.0 | 1.06 | 0.034 | 0.002 | 0.028 |
| 5.0 | 1.02 | 0.033 | 0.014 | 0.016 |
| 6.0 | 0.96 | 0.018 | 0.010 | 0.014 |
| 7.0 | 0.90 | 0.023 | 0.014 | 0.022 |
| 8.0 | 0.85 | 0.026 | 0.016 | 0.030 |
| 9.0 | 0.78 | 0.037 | 0.018 | 0.022 |
| 10.0 | 0.71 | 0.017 | 0.012 | 0.004 |
| 11.0 | 0.66 | 0.016 | 0.017 | 0.011 |
| 12.0 | 0.60 | 0.007 | 0.032 | 0.004 |
| 13.0 | 0.53 | 0.004 | 0.014 | 0.013 |
| 14.0 | 0.48 | 0.007 | 0.019 | 0.003 |
| 15.0 | 0.44 | 0.007 | 0.015 | 0.013 |
| 16.0 | 0.38 | 0.007 | 0.022 | 0.019 |
| 17.0 | 0.38 | 0.004 | 0.015 | 0.007 |
| 18.0 | 0.36 | 0.001 | 0.009 | 0.003 |
| 19.0 | 0.35 | 0.007 | 0.008 | 0.009 |
| 20.0 | 0.34 | 0.004 | 0.003 | 0.008 |
| 21.0 | 0.35 | 0.005 | 0.009 | 0.008 |

EXAMPLE 2

KODACOLOR GOLD 100 Color Negative Film (5095) was exposed as described in Example 1 and processed at 100° F. according to the protocol shown below. The bleach used was either the comparative iron chelate bleach or inventive Bleach C.

| Solution | Time (min) |
|---|---|
| Color Developer | 3.25 |
| Acid Stop Bath | 1.00 |
| Water Wash | 1.00 |
| Bleach | 4.00 |
| Water Wash | 3.00 |
| Fix | 4.00 |
| Water Wash | 3.00 |
| PHOTO-FLO | 1.00 |

| Component | Concentration |
|---|---|
| Color Developer | |
| Potassium carbonate | 34.30 g/l |
| Potassium bicarbonate | 2.32 g/l |
| Sodium sulfite | 0.38 g/l |
| Sodium metabisulfite | 2.78 g/l |
| Potassium iodide | 1.20 mg/l |
| Sodium bromide | 1.31 g/l |
| Diethylenetriaminepentaacetic acid pentasodium salt | 3.37 g/l |
| Hydroxylamine sulfate | 2.41 g/l |

-continued

| | |
|---|---|
| 4-(N-ethyl-N-(2-hydroxyethyl)-amino)-2-methylaniline sulfate | 4.52 g/l |
| pH | 10.0 |
| Acid Stop Bath | |
| Sulfuric acid | 10 ml/l |
| Fixer | |
| Ammonium thiosulfate | 124.6 g/l |
| Ammonium sulfite | 8.83 g/l |
| Ethylenedinitrilotetraacetic acid, disodium salt, dihydrate | 1.45 g/l |
| Sodium metabisulfite | 5.5 g/l |
| Acetic acid | 0.97 g/l |
| Water to make | 1 liter |
| pH | 6.4 |
| Stabilizer | |
| Photo-Flo 200 Solution (manufactured by Eastman Kodak Co.) | 3 ml/l |
| Comparative Bleach | |
| Ammonium bromide | 25.0 g/l |
| 1,3-Diaminopropanetetraacetic acid | 37.4 g/l |
| Ferric nitrate nonahydrate | 45 g/l |
| 28% aqueous ammonia | 70 ml/l |
| Glacial acetic acid | 80 ml/l |
| 1,3-Diamino-2-hydroxypropane-N,N,N',N'-tetraacetic acid | 0.8 g/l |
| pH | 4.75 |
| Bleach C | |
| hydrogen peroxide | 0.980 mol/l |
| phthalic acid monopotassium salt | 0.035 mol/l |
| water to 1 liter | |
| pH adjusted to 5.0 with NaOH | |

The residual silver levels in the processed strips were determined by X-ray fluorescence and are shown in Table II. The data in Table II demonstrate that the inventive bleach desilvers the developed film satisfactorily. No vesiculation was observed in the bleached strips.

TABLE II

| | Residual Silver ($g/m^2$) | | |
|---|---|---|---|
| Step No. | No Bleach | Comparative Bleach | Bleach C |
| 1.0 | 1.36 | 0.019 | 0.026 |
| 2.0 | 1.31 | 0.018 | 0.024 |
| 3.0 | 1.26 | 0.018 | 0.026 |
| 4.0 | 1.20 | 0.019 | 0.034 |
| 5.0 | 1.16 | 0.022 | 0.042 |
| 6.0 | 1.11 | 0.023 | 0.038 |
| 7.0 | 1.07 | 0.024 | 0.033 |
| 8.0 | 1.00 | 0.023 | 0.040 |
| 9.0 | 0.93 | 0.022 | 0.045 |
| 10.0 | 0.86 | 0.017 | 0.033 |
| 11.0 | 0.80 | 0.014 | 0.022 |
| 12.0 | 0.75 | 0.012 | 0.019 |
| 13.0 | 0.70 | 0.013 | 0.023 |
| 14.0 | 0.63 | 0.020 | 0.028 |
| 15.0 | 0.56 | 0.026 | 0.033 |
| 16.0 | 0.51 | 0.016 | 0.027 |
| 17.0 | 0.47 | 0.007 | 0.022 |
| 18.0 | 0.45 | 0.004 | 0.025 |
| 19.0 | 0.44 | 0.005 | 0.031 |
| 20.0 | 0.44 | 0.004 | 0.034 |
| 21.0 | 0.45 | 0.004 | 0.037 |

EXAMPLE 3

KODACOLOR GOLD 100 Color Negative Film (5095) was exposed as described in Example 1 and processed at 100° F. according to the protocol described in Example 2. The bleach used was either the comparative iron chelate bleach or inventive Bleach D.

| Bleach D | |
|---|---|
| hydrogen peroxide | 0.980 mol/l |
| phthalic acid monopotassium salt | 0.035 mol/l |
| 1-hydroxyethylidene-1,1-diphosphonic acid | 0.004 mol/l |
| water to 1 liter | |
| pH adjusted to 4.5 with NaOH | |

The residual silver levels in the processed strips were determined by X-ray fluorescence and are shown in Table III. The data in Table III demonstrates that the inventive bleach desilvers the developed film satisfactorily. No vesiculation was observed in the bleached strips.

TABLE III

| | Residual Silver ($g/m^2$) | | |
|---|---|---|---|
| Step No. | No Bleach | Comparative Bleach | Bleach D |
| 1.0 | 1.32 | 0.015 | 0.037 |
| 2.0 | 1.30 | 0.019 | 0.031 |
| 3.0 | 1.27 | 0.025 | 0.029 |
| 4.0 | 1.19 | 0.031 | 0.029 |
| 5.0 | 1.12 | 0.032 | 0.033 |
| 6.0 | 1.07 | 0.036 | 0.043 |
| 7.0 | 1.02 | 0.027 | 0.048 |
| 8.0 | 0 96 | 0.019 | 0.032 |
| 9.0 | 0.90 | 0.014 | 0.016 |
| 10.0 | 0.84 | 0.011 | 0.018 |
| 11.0 | 0.79 | 0.011 | 0.027 |
| 12.0 | 0.73 | 0.016 | 0.034 |
| 13.0 | 0.67 | 0.022 | 0.039 |
| 14.0 | 0.61 | 0.015 | 0.027 |
| 15.0 | 0.55 | 0.008 | 0.014 |
| 16.0 | 0.50 | 0.004 | 0.012 |
| 17.0 | 0.46 | 0.004 | 0.014 |
| 18.0 | 0.45 | 0.001 | 0.013 |
| 19.0 | 0.44 | 0.000 | 0.014 |
| 20.0 | 0.44 | 0.000 | 0.014 |
| 21.0 | 0.45 | 0.000 | 0.015 |

EXAMPLE 4

KODAK GOLD 100 PLUS Color Negative Film (5102) was exposed and processed as described in Example 1. The bleach used was either the comparative iron chelate bleach or inventive Bleach E.

| Bleach E | |
|---|---|
| water | 700 ml |
| 25 wt % (in $H_2O$)4-sulfophthalic acid | 95 ml |
| 30% hydrogen peroxide | 100 ml |
| 50% NaOH | 15.3 ml |
| silver nitrate (in 40 ml $H_2O$) | 0.80 g |
| water added to final volume of 1 liter | |
| final pH 4.01 | |

Status M red, green, and blue densities measured at each exposure step are shown in Table IV. The data in Table IV shows that the dye images obtained with the inventive Bleach E are comparable to those obtained with the comparative iron chelate bleach.

TABLE IV

| Step No. | Residual Silver ($g/m^2$) Comparative Bleach | Bleach E |
|---|---|---|
| 1.0 | 2.14/2.74/3.13 | 2.12/2.74/3.16 |
| 2.0 | 2.08/2.66/3.06 | 2.05/2.65/3.09 |
| 3.0 | 2.00/2.56/2.96 | 1.97/2.54/2.95 |
| 4.0 | 1.88/2.42/2.82 | 1.85/2.40/2.82 |
| 5.0 | 1.76/2.29/2.67 | 1.73/2.27/2.67 |
| 6.0 | 1.62/2.15/2.50 | 1.60/2.12/2.49 |
| 7.0 | 1.49/2.00/2.34 | 1.48/1.98/2.35 |
| 8.0 | 1.38/1.86/2.20 | 1.36/1.84/2.20 |
| 9.0 | 1.27/1.75/2.08 | 1.26/1.72/2.07 |
| 10.0 | 1.15/1.63/1.93 | 1.14/1.61/1.92 |
| 11.0 | 1.02/1.51/1.78 | 1.01/1.49/1.77 |
| 12.0 | 0.89/1.37/1.63 | 0.89/1.36/1.62 |
| 13.0 | 0.78/1.23/1.50 | 0.77/1.22/1.49 |
| 14.0 | 0.66/1.10/1.37 | 0.66/1.09/1.37 |
| 15.0 | 0.55/0.98/1.24 | 0.55/0.97/1.24 |
| 16.0 | 0.45/0.88/1.13 | 0.45/0.87/1.13 |
| 17.0 | 0.38/0.82/1.03 | 0.38/0.81/1.03 |
| 18.0 | 0.34/0.80/0.98 | 0.35/0.79/0.98 |
| 19.0 | 0.33/0.78/0.95 | 0.33/0.78/0.95 |
| 20.0 | 0.32/0.78/0.94 | 0.32/0.77/0.94 |
| 21.0 | 0.32/0.78/0.94 | 0.32/0.77/0.94 |

EXAMPLE 5

Application of the Invention in a Black and White Process

The levels of developed silver that a black and white reversal bleach must remove are often much higher than the levels of silver developed in a color process. The following example illustrates the use of an inventive bleach in the black and white processing of a film in which high levels of developed silver must be removed.

A black and white multilayer film coating having the structure shown below was prepared. The numbers in parentheses indicate the component laydowns in $g/m^2$. Thus the multilayer film contained a total of 3.62 $g/m^2$ silver and 8.57 $g/m^2$ gel. All emulsions used in the multilayer were fully sensitized, bromoiodide, tabular grain emulsions.

| | |
|---|---|
| Blue Silver | (1.18) |
| Gelatin | (2.37) |
| Yellow Filter Dye | (0.22) |
| Gelatin | (0.65) |
| Green Silver | (0.97) |
| Gelatin | (1.94) |
| Magenta Filter Dye | (0.22) |
| Gelatin | (0.65) |
| Red Silver | (1.47) |
| Gelatin | (2.96) |

The multilayer film was exposed as described in Example 1 and processed according to the following protocol.

| Solution | Time (min) | Temp (°F.) |
|---|---|---|
| B&W Developer | 3.5 | 100 |
| Acid Stop Bath | 1 | 100 |
| Water Wash | 3 | 100 |
| Bleach F | 10 | 100 |
| Water Wash | >14 | 75 |
| Fix | 8 | 75 |
| Water Wash | 5 | 75 |
| Stabilizer | 0.50 | 75 |

-continued

| | |
|---|---|
| B&W Developer | |
| water | 1000 ml |
| p-methylaminophenol sulfate | 2.5 g |
| 1-ascorbic acid | 10 g |
| potassium bromide | 1.0 g |
| KODAK BALANCED ALKALI | 35 g |
| sodium metabisulfite | 21.04 g |
| sodium sulfite | 2.88 g |
| Acid Stop Bath | |
| Glacial acetic acid | 30 ml/l |
| Fixer | |
| Sodium Thiosulfate pentahydrate | 240 g/l |
| Sodium sulfite anhydrous | 10 g/l |
| Sodium bisulfite | 25 g/l |
| water to make | 1 liter |
| Stabilizer | |
| Photo-Flo 200 Solution (manufactured by Eastman Kodak Co.) | 3 ml/l |
| Bleach F | |
| water | 750 ml |
| phthalic acid monopotassium salt | 81.68 g |
| 30% hydrogen peroxide | 100 ml |
| adjust pH to approx. 4.5 with 50% NaOH | |
| silver nitrate (in 40 mL $H_2O$) | 0.80 g |
| water added to final volume of 1 liter | |
| final pH 4.44 | |

X-ray fluorescence measurements of the residual silver levels in the processed multilayer are shown in Table V. The results demonstrate that the inventive bleach successfully desilvered the high levels of developed silver. No vesiculation was observed in the bleached film.

TABLE V

| Step No. | Residual Silver ($g/m^2$) No Bleach | Bleach F |
|---|---|---|
| 1.0 | 3.35 | 0.004 |
| 2.0 | 3.31 | 0.009 |
| 3.0 | 3.26 | 0.013 |
| 4.0 | 3.20 | 0.004 |
| 5.0 | 3.14 | 0.002 |
| 6.0 | 3.04 | 0.024 |
| 7.0 | 2.84 | 0.018 |
| 8.0 | 2.65 | 0.007 |
| 9.0 | 2.47 | 0.001 |
| 10.0 | 2.19 | 0.005 |
| 11.0 | 1.85 | 0.020 |
| 12.0 | 1.55 | 0.015 |
| 13.0 | 1.25 | 0.013 |
| 14.0 | 0.99 | 0.009 |
| 15.0 | 0.74 | 0.012 |
| 16.0 | 0.54 | 0.017 |
| 17.0 | 0.39 | 0.016 |
| 18.0 | 0.33 | 0.003 |
| 19.0 | 0.29 | 0.000 |
| 20.0 | 0.27 | 0.000 |
| 21.0 | 0.27 | 0.000 |

The invention has been described in detail with particular reference to preferred embodiments thereof, but it will be understood that variations and modifications can be effected within the spirit and scope of the invention.

What is claimed is:

1. A method of processing an imagewise exposed and developed silver halide photographic element comprising bleaching the photographic element with a non-rehalogenating bleaching composition having a pH of from about 2 to about 6, and comprising:

(a) hydrogen peroxide in an amount of from about 0.05 to about 5 mol/l, or a perborate, percarbonate or hydrogen peroxide urea precursor which releases hydrogen peroxide in an aqueous solution at a pH of from about 2 to about 6, said precursor being present in an amount sufficient to provide hydrogen peroxide in an amount of from about 0.05 to about 5 mol/l, and (b) from about 0.01 to about 2 mol/l of an aromatic carboxylic acid or salt thereof, which is a sulfobenzoic acid, a sulfonaphthalenecarboxylic acid, a benzenedicarboxylic acid, a naphthalenedicarboxylic acid, a sulfobenzenedicarboxylic acid, a sulfonaphthalenedicarboxylic acid, a benzenetricarboxylic acid, a sulfobenzenetricarboxylic acid, a benzenetetracarboxylic acid, or a disulfobenzenecarboxylic acid, or a salt thereof provided that said bleaching composition is substantially free of:

rehalogenating agents, and any complexes formed from a high valent metal ion and a polycarboxylic acid, aminocarboxylic acid or phosphonic acid.

2. The method of claim 1 wherein said bleaching composition further comprises an organic phosphonic acid or salt represented by formula (VI):

$$R^7N\ (CH_2PO_3M'_2)_2 \qquad \text{(VI)}$$

wherein M' represents a hydrogen atom or a cation imparting water solubility; and $R^7$ represents an alkyl group, an alkylaminoalkyl group, or an alkoxyalkyl group having from 1 to 4 carbon atoms, an aryl group, an aralkyl group, an alicyclic group, or a heterocyclic group, each of which may be substituted with a hydroxyl group, an alkoxy group, a halogen atom, $—PO_3M'_2$, $—CH_2PO_3M'_2$, or $—N(CH_2PO_3M'_2)_2$, wherein M' is as defined above, or by formula (VII):

$$R^8R^9C(PO_3M'_2)_2 \qquad \text{(VII)}$$

wherein M' is as defined above; $R^8$ represents a hydrogen atom, an alkyl group, an aralkyl group, an alicyclic group, or a heterocyclic group, or $—CHR^{10}—PO_3M'_2$, wherein M' is as defined above and $R^{10}$ represents a hydrogen atom, a hydroxy group, or an alkyl group, or $—PO_3M'_2$ wherein M' is as defined above; and $R^9$ represents a hydrogen atom, a hydroxyl group, an alkyl group, or a substituted alkyl group or $—PO_3M'_2$ wherein M' is as defined above.

3. The method of claim 1 wherein said bleaching composition further comprises soluble silver(I).

4. The method of claim 1 wherein said imagewise exposed and developed photographic element has been color developed, and after said color development, is contacted with an acid stop solution prior to said bleaching.

5. The method of claim 2 wherein said phosphonic acid or salt is present in an amount of from about 0.0005 to about 0.02 mol/l.

6. The method of claim 1 wherein said bleaching composition comprises no more than about $10^{-4}$ mol of said high valent metal complex, per liter of solution.

7. The method of claim 1 wherein carboxylic acid or salt thereof is m-sulfobenzoic acid, phthalic acid, 4-sulfophthalic acid, 5-sulfoisophthalic acid, or 3-sulfophthalic acid, or a salt thereof.

8. The method of claim 1 wherein said carboxylic acid is present at a concentration of from about 0.03 to about 1.0 mol/l.

* * * * *